US008936445B2

(12) United States Patent
Hazelton et al.

(10) Patent No.: US 8,936,445 B2
(45) Date of Patent: Jan. 20, 2015

(54) REDUCED NOISE FLUID PUMP

(75) Inventors: Gary J. Hazelton, White Lake, MI (US); Joseph J. Noonchester, New Hudson, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 326 days.

(21) Appl. No.: 13/207,487

(22) Filed: Aug. 11, 2011

(65) Prior Publication Data

US 2013/0039793 A1 Feb. 14, 2013

(51) Int. Cl.

| | |
|---|---|
| ***F04B 17/00*** | (2006.01) |
| ***F04B 35/00*** | (2006.01) |
| ***F01C 21/00*** | (2006.01) |
| ***F04C 15/00*** | (2006.01) |
| ***F03C 2/00*** | (2006.01) |
| ***F03C 4/00*** | (2006.01) |
| ***F04C 2/00*** | (2006.01) |
| ***F01C 1/18*** | (2006.01) |
| ***F01C 1/24*** | (2006.01) |
| ***F01C 21/10*** | (2006.01) |
| ***F04C 2/08*** | (2006.01) |
| *F04C 29/06* | (2006.01) |
| *F04C 2/14* | (2006.01) |

(52) U.S. Cl.

CPC ..... *F01C 21/108* (2013.01); *F04C 2/088* (2013.01); *F04C 29/068* (2013.01); *F04C 2/14* (2013.01); *F04C 2270/13* (2013.01)

USPC ..... 417/364; 418/189; 418/206.1

(58) Field of Classification Search

CPC ..... F04C 2/088; F04C 2/18; F04C 2/084; F04B 17/05

USPC ..... 417/364; 418/189, 190, 188, 187, 418/206.1, 206.3, 206.5

See application file for complete search history.

(56) References Cited

U.S. PATENT DOCUMENTS 2,884,864 A * 5/1959 Bobnar ..... 418/135
3,303,792 A * 2/1967 Littlewood ..... 418/189

(Continued)

FOREIGN PATENT DOCUMENTS

WO WO 2010/150388 A1 * 12/2010
WO WO 2010150388 A1 * 12/2010

OTHER PUBLICATIONS

English translation of WO 2010/150388 A1, Dec. 29, 2010, Inventor: Tomo Sato.*

*Primary Examiner* — Devon Kramer
*Assistant Examiner* — Lilya Pekarskaya
(74) *Attorney, Agent, or Firm* — Quinn Law Group, PLLC

(57) ABSTRACT

A fluid pump includes a housing that defines a suction chamber, a discharge chamber, and a barrier having a first height, wherein the barrier is configured to separate the suction chamber from the discharge chamber. The pump also includes meshed first and second gears rotatably disposed in the housing. The gears are configured to draw relatively low-pressure fluid from the suction chamber, transform the relatively low-pressure fluid into relatively high-pressure fluid, and release the relatively high-pressure fluid into the discharge chamber. The barrier includes first and second portions configured to accept the first and second gears respectively, and a bridge connecting the first and second portions. The bridge is disposed proximately to where the gears mesh and is configured to provide a transition from the first height to a second height to thereby generate gradual re-expansion of the fluid away from the bridge.

17 Claims, 3 Drawing Sheets

(56) References Cited

U.S. PATENT DOCUMENTS

| | | | | |
|---|---|---|---|---|
| 3,474,736 | A * | 10/1969 | Lauck | 418/74 |
| 4,239,468 | A * | 12/1980 | Smith | 418/78 |
| 6,312,241 | B1 * | 11/2001 | Kamamoto et al. | 418/189 |
| 6,390,793 | B1 * | 5/2002 | Sweet et al. | 418/132 |
| 6,948,471 | B1 * | 9/2005 | Odashima | 123/196 R |
| 7,479,000 | B2 * | 1/2009 | Klassen | 418/206.5 |
| 8,087,914 | B1 * | 1/2012 | Soderstrom | 418/206.5 |
| 2009/0123316 | A1 * | 5/2009 | Klassen | 418/61.1 |
| 2010/0143175 | A1 * | 6/2010 | Abu Samra et al. | 418/206.1 |

* cited by examiner

REDUCED NOISE FLUID PUMP

TECHNICAL FIELD

The present disclosure relates to a fluid pump characterized by reduced noise.

BACKGROUND

A pump is a device used to move fluids, such as liquids, gases, or slurries. A pump displaces a volume of a fluid by physical or mechanical action. A gear pump is a type of a pump that uses two meshed gears rotating in a closely fitted casing to displace a work fluid. Gear pumps are used to pump a constant amount of fluid for each revolution of the meshed gears.

As the gears rotate they separate on the intake side of the pump, creating a void and suction which is filled by fluid. The fluid is carried by the gears to the discharge side of the pump, where the meshing of the gears displaces the fluid. The mechanical clearances are typically small—on the order of 10 μm. Such tight clearances, along with the gears' speed of rotation, effectively prevent the fluid from leaking backwards. The rigid design of the gears and the pump housing allow for very high pressures and the ability to pump highly viscous fluids.

There are two main variations of gear pumps: external gear pumps, which use two meshed external spur gears, and internal gear pumps, which use an external gear rotating inside an internal spur gear. Both external and internal gear pumps are widely used in motor vehicles to pump lubricating oil to vital powertrain components. During operation, gear pumps typically generate various noises.

SUMMARY

A fluid pump includes a housing that defines a suction chamber, a discharge chamber, and a barrier having a first height, wherein the barrier is configured to separate the suction chamber from the discharge chamber. The pump also includes first and second gears rotatably disposed in the housing. The first and second gears are configured to mesh and pull or draw relatively low-pressure fluid from the suction chamber, transform the relatively low-pressure fluid into relatively high-pressure fluid, and release the relatively high-pressure fluid into the discharge chamber. The barrier includes first and second portions configured to accept the first and second gears respectively and a bridge connecting the first and second portions. The bridge is disposed proximately to where the first and second gears mesh and includes a section configured to provide a transition from the first height to a second height. As a result, the section generates gradual re-expansion of the fluid away from the bridge and minimizes pump noise.

The transition from the first height to the second height may include a ramp. Alternatively, the transition from the first height to the second height may include a step, which may include a first fillet arranged at the transition from the first height to the second height.

The barrier may include a second fillet where the bridge connects to the first portion and a third fillet where the bridge connects to the second portion.

The section providing the transition from the first height to the second height may face the suction chamber.

The transition from the first height to the second height may be either cast into or machined into the barrier.

Each of the meshed first and second gears may be an external spur gear type.

An internal combustion engine having an oil pump, such as the positive displacement fluid pump described above, and a vehicle employing such an engine are also disclosed.

The above features and advantages and other features and advantages of the present invention are readily apparent from the following detailed description of the best modes for carrying out the invention when taken in connection with the accompanying drawings.

DETAILED DESCRIPTION

Figure 1:
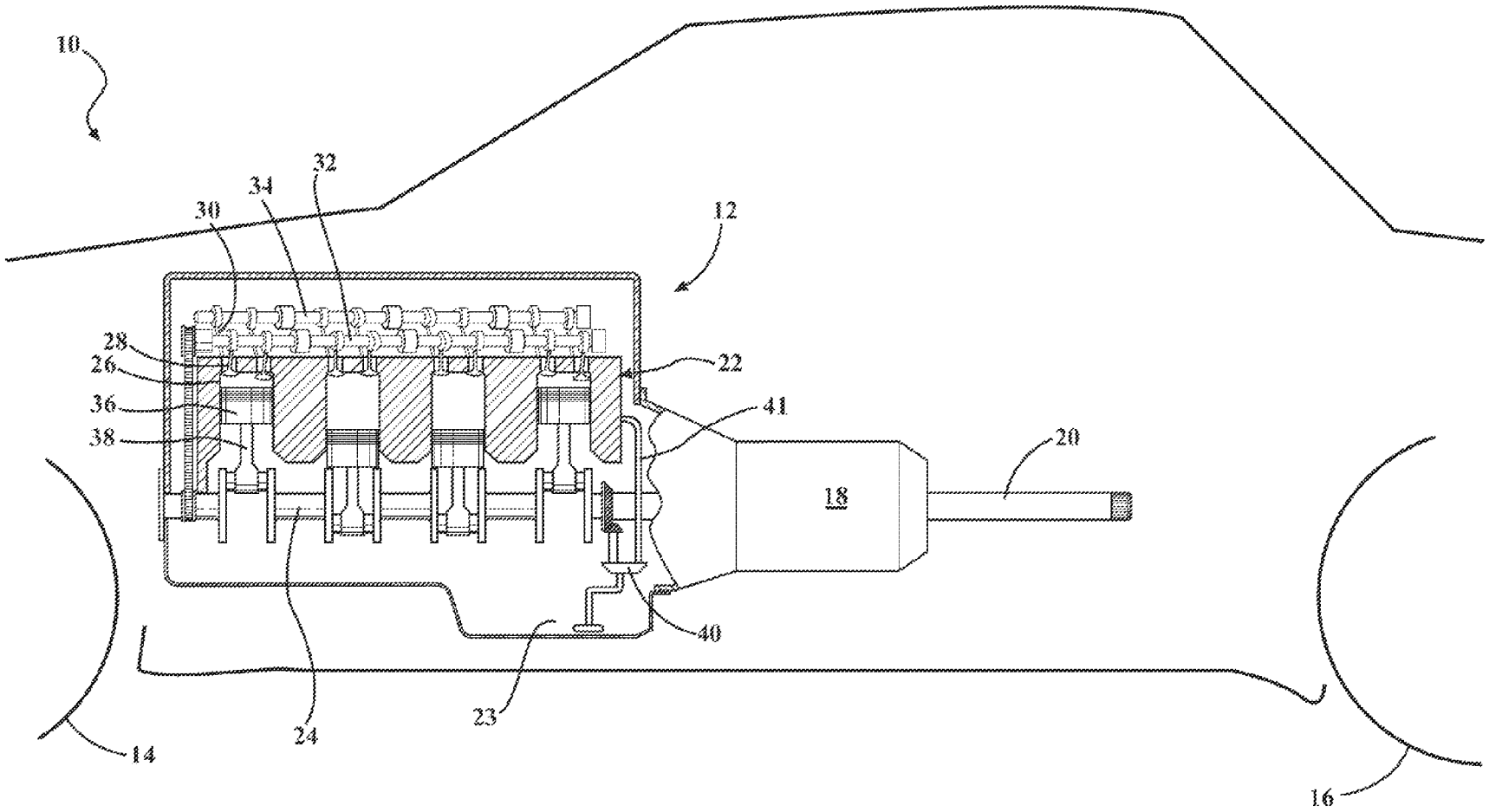
FIG. 1 is a schematic illustration of a motor vehicle including an internal combustion engine employing an oil pump.

Referring to the drawings, wherein like reference numbers refer to like components, FIG. 1 shows a schematic view of a motor vehicle 10. The vehicle 10 incorporates a powertrain that includes an internal combustion engine 12, such as a spark or a compression ignition type, adapted for driving wheels 14 and/or wheels 16 to propel the vehicle. The engine 12 applies its torque to the driven wheels 14 and/or 16 through a transmission 18 and via a drive or a propeller shaft 20.

The engine 12 includes a cylinder block 22 and an oil sump 23. The cylinder block houses a crankshaft 24 and cylinders 26. Each cylinder 26 is provided with intake valves 28 and exhaust valves 30 that may be actuated by respective intake and exhaust camshafts 32, 34, as shown in FIG. 1. The intake valves 28 are configured to control a supply of air or of air and fuel into the respective cylinder 26, while the exhaust valves 30 are configured to control the removal of post combustion exhaust gas from the respective cylinder. Each cylinder 26 also includes a piston 36 and a connecting rod 38. The pistons 36 are configured to reciprocate under the force of combustion inside their respective cylinders 26, and thereby rotate the crankshaft 24 via the connecting rods 38.

The crankshaft 24, camshafts 32, 34, connecting rods 38 and various other rotating or otherwise frequently moving components of the engine 12 are supported by specifically configured bearings (not shown). Typically, such bearings rely on a film of oil established between a surface of the bearing and the supported component to create a reliable low friction interface. Typically, the oil used in internal combustion engines is a specially formulated fluid that is derived from petroleum-based and non-petroleum chemical compounds. Such oil is mainly blended by using base oil composed of hydrocarbons and other chemical additives for a specific engine application.

Figure 2:
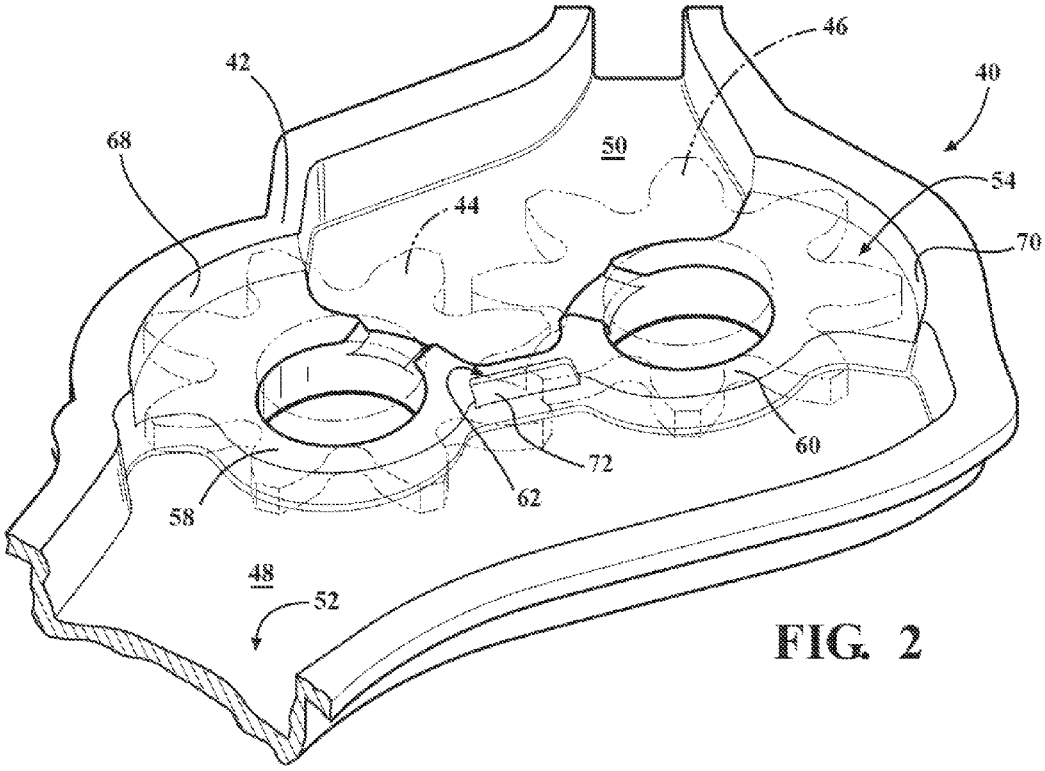
FIG. 2 is an illustration of the oil pump shown in FIG. 1.

The engine 12 also includes a fluid pump 40 configured to draw oil from the sump 23, and then pressurize and supply the oil to a main oil gallery 41. The gallery 41, in turn, distributes the pressurized oil to the engine bearings of the crankshaft 24, camshafts 32, 34, connecting rods 38, and to other components that rely on the oil for lubrication, actuation, and/or cooling. As shown in FIG. 2, the pump 40 is configured as a positive displacement gear pump. The pump 40 may be driven mechanically by the engine 12, such as by the one of the camshafts 32, 34 or the crankshaft 24, or be operated electrically.

The pump 40 includes a housing 42 and meshed first and second gears 44, 46. The first and second gears 44, 46 are rotatably disposed in the housing 42, and, as shown, may be external spur gear type. The housing 42 defines a suction chamber 48 and a discharge chamber 50. The housing 42 also includes an inlet port for admitting relatively low-pressure inlet oil into the pump 40, and an outlet port for discharging relatively high-pressure outlet fluid from the pump. Although neither the inlet nor the outlet port is shown, the existence of the two ports would be readily appreciated by those skilled in the art.

As intended by the embodiment shown in FIG. 2, the pump 40 may be attached and hermetically sealed to the cylinder block 22, or the housing 42 may include a separate cover (not shown). The housing 42 may be cast from an appropriate rigid material that is capable of withstanding internal pressures generated by the pump 40, such as aluminum or magnesium. After the housing 42 is cast, specific features may also be machined for added precision. The housing 42 includes a base surface 52 and additionally defines a barrier 54 having a first height 56.

The barrier 54 is arranged substantially perpendicular to the base surface 52 and is configured to separate the suction chamber 48 from the discharge chamber 50 such that the suction and discharge chambers may only communicate through the meshed first and second gears 44, 46. The barrier 54 includes a first portion 58 and second portion 60. The first and second portions 58, 60 are configured to accept the first and second gears 44, 46, respectively. The barrier 54 also includes a bridge 62 spanning the distance between, and thus connecting the first and second portions 58, 60. The bridge 62 is disposed proximately to an area 63 where the first and second gears 44, 46 mesh.

During operation of the pump 40, the suction chamber 48 receives oil from the sump 23. The meshed first and second gears 44, 46 pull or draw relatively low-pressure oil from the suction chamber 48, and is carried into the discharge chamber 50 while being trapped between the outer periphery of the gears and specially formed or machined areas 68 and 70 of the housing 42. Additionally, the first and second gears 44, 46 transform the relatively low-pressure oil into relatively high-pressure oil by squeezing and displacing the oil from between engaged teeth 64 and 66 (shown in FIG. 3) of the respective gears 44, 66 as the gears mesh within the discharge chamber 50.

Figure 3:
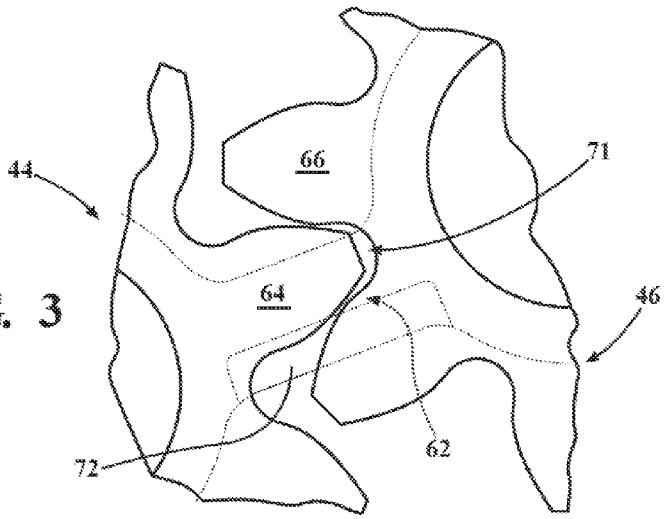
FIG. 3 is a close-up illustration of meshed gears inside the oil pump shown in FIG. 2, showing a volume of oil trapped between the gears.

As the gears 44, 66 continue to rotate and pass over the bridge 62, the engaged teeth 64, 66 release the relatively high-pressure oil into the discharge chamber 50 before a minimum oil volume 71 is captured or trapped between the engaged teeth, as shown in FIG. 3. After the engaged teeth 64, 66 have traversed the bridge 62, the minimum oil volume 71 remaining trapped between the engaged teeth is released back into the suction chamber 48. Therefore, the oil is pumped around the outer periphery of the meshed first and second gears 44, 46 by being trapped in the spaces of the engaged teeth 64, 66. Because the teeth of the first and second gears 44, 46 are configured to engage with precision, the oil is only permitted to travel in one direction.

Figure 4:
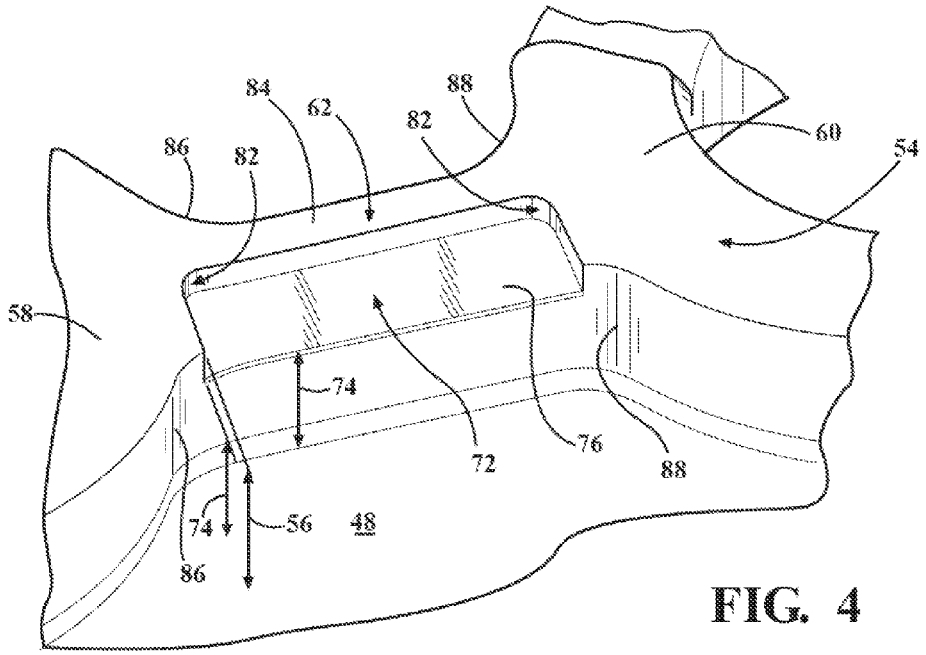
FIG. 4 is an illustration of a first embodiment of a suction side of the oil pump shown in FIG. 1, with the meshed pump gears not shown.
Figure 5:
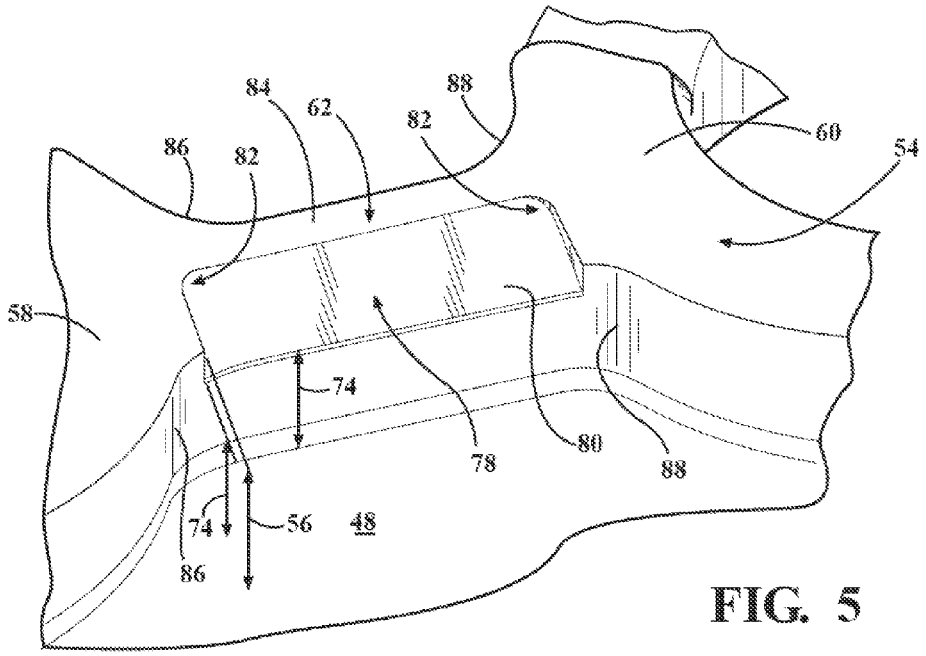
FIG. 5 is an illustration of a second embodiment of the suction side of the oil pump shown in FIG. 1, with the meshed pump gears not shown.

As shown in FIGS. 2 and 5, the bridge 62 includes a section 72 that provides a transition from the first height 56 to a second height 74 (shown in FIG. 4). The transition established from the first height 56 to the second height 74 by the section 72 generates gradual re-expansion of the oil away from the bridge 62. The length of the section 72 may be substantially coextensive with the length of the bridge, i.e., extend across the bridge from the first portion 58 substantially to the second portion 60, or cover only a portion of the bridge's length. The section 72 is arranged on the side of the bridge 62 that faces the suction chamber 48. Accordingly, the section 72 is configured to generate gradual re-expansion into the suction chamber 48 of the minimum oil volume 71 remaining between the engaged teeth 64, 66 (as shown in FIG. 3). The section 72 as shown includes a step 76 that reduces the height of the bridge 62 relative to the base surface 52 from the first height 56 to the second height 74.

The step 76 may be cast and/or machined into the barrier 54. As the relatively high-pressure oil being generated by the engaged teeth 64, 66 is released into the discharge chamber 50, the section 72 permits the oil to be released gradually such that the dissipation of the relatively high-pressure oil into the discharge chamber is controlled. Without the section 72 being incorporated into the bridge 62, the abrupt expansion of the minimum oil volume 71 (shown in FIG. 3) upon the oil's release into the suction chamber 48 would generate sharp pressure pulses and attendant noise. Thus, the gradual re-expansion of the minimum oil volume 71 away from the bridge 62 and into the suction chamber 48, serves to minimize the noise emitted by the pump 40 during operation thereof.

As shown in FIGS. 2 and 5, the bridge 62 includes a section 78 configured to provide a transition from the first height 56 to a second height 74 (shown in FIG. 5) to thereby generate gradual re-expansion of the oil away from the bridge. The section 78 is arranged on the side of the bridge 62 that faces the discharge chamber 50. Accordingly, the section 78 is configured to generate gradual re-expansion of the relatively high-pressure oil away from the bridge 62 and into the discharge chamber 50. The length of the section 78 may be substantially coextensive with the length of the bridge 62, as shown. The section 78 as shown includes a ramp 80 that gradually reduces the height of the bridge 62 relative to the base surface 52 from the first height 56 to the second height 74.

The ramp 80 may be cast and/or machined into the barrier 54. As the oil is progressively reintroduced into the suction chamber 48 across the ramp 80 by the engaged teeth 64, 66 the pressure dissipation from the minimum oil volume 71 (shown in FIG. 3) is controlled. Thus, the gradual re-expansion of the minimum oil volume 71 away from the bridge 62 and into the suction chamber 48, serves to minimize the noise emitted by the pump 40 during operation thereof. The ramp 80 may be cast and/or machined into the barrier 54. The section 78 is arranged on the side of the bridge 62 that faces the suction chamber 48. Accordingly, like the section 72 described above, the section 78 is configured to generate gradual re-expansion into the suction chamber 48 of the minimum oil volume 71 remaining between the engaged teeth 64, 66. Similar to the effect of the section 72, the gradual re-expansion of the oil across the section 78 into the suction chamber 48 serves to minimize the noise emitted by the pump 40 during operation thereof.

When either the section 72 or the section 78 is included in the bridge 62, a landing 84 of some predetermined width will be retained in order to positively separate the suction and the discharge chambers 48, 50. The second height 74 of the sections 72 and 78, as well as the selection of the step 76 versus the ramp 80 may be determined empirically, during testing and development of the pump 40. The selection of the second height 74 and the shape of the sections 72 and 78 may be based on the combination of required performance and the desired level of noise from the pump 40.

As shown in each of FIGS. 4-5, the sections 72 and 78 may include first fillets 82 arranged at the transition from the first height 56 to the second height 74. Additionally, the barrier 54 may include a second fillet 86 on each side of the bridge 62 where the bridge connects to the first portion 58 and a third fillet 88 on each side of the bridge where the bridge connects to the second portion 60. The fillets 86 and 88 may be particularly beneficial when the length of the section 72 is substantially coextensive with the length of the bridge 62, as shown in FIGS. 2 and 3. Thus positioned, fillets 82, 86, and 88 facilitate smooth expansion of the oil from the engaged teeth 64, 66 and into the respective suction and discharge chambers 48, 50.

While the best modes for carrying out the invention have been described in detail, those familiar with the art to which this invention relates will recognize various alternative designs and embodiments for practicing the invention within the scope of the appended claims.

The invention claimed is:

1. A fluid pump comprising:

a housing that includes a base surface and defines a suction chamber, a discharge chamber, and a barrier extending from and arranged perpendicular to the base surface and having a first height relative to the base surface, wherein the barrier is configured to separate the suction chamber from the discharge chamber; and first and second gears rotatably disposed in the housing, configured to mesh and draw relatively low-pressure fluid from the suction chamber, transform the relatively low-pressure fluid into relatively high-pressure fluid, and release the relatively high-pressure fluid into the discharge chamber;

wherein the barrier includes first and second portions configured to accept the first and second gears respectively, and a bridge connecting the first and second portions, the bridge being disposed proximately to where the first and second gears mesh;

wherein the bridge includes a ramp configured as a plane surface sloped relative to the base surface to provide a gradual transition from the first height to a second height such that height of the bridge is reduced relative to the base surface; and wherein the ramp generates a gradual re-expansion of the fluid away from the bridge and thereby reduces pump noise.

2. The fluid pump of claim 1, wherein the ramp faces the suction chamber.

3. The fluid pump of claim 1, wherein the transition from the first height to the second height is one of cast and machined into the barrier.

4. The fluid pump of claim 1, wherein each of the first and second gears is an external spur gear type.

5. The fluid pump of claim 1, wherein the ramp includes a first fillet arranged at the transition from the first height to the second height.

6. The fluid pump of claim 5, wherein the barrier includes a second fillet where the bridge connects to the first portion and a third fillet where the bridge connects to the second portion.

7. An internal combustion engine comprising:

a cylinder block having an oil gallery; and a fluid pump configured to supply oil to the oil gallery, the pump having:

a housing that includes a base surface and defines a suction chamber, a discharge chamber, and a barrier extending from and arranged perpendicular to the base surface and having a first height relative to the base surface, wherein the barrier is configured to separate the suction chamber from the discharge chamber; and first and second gears rotatably disposed in the housing, configured to mesh and draw relatively low-pressure oil from the suction chamber, transform the relatively low-pressure oil into relatively high-pressure oil, and release the relatively high-pressure oil into the discharge chamber;

wherein the barrier includes first and second portions configured to accept the first and second gears respectively, and a bridge connecting the first and second portions, the bridge being disposed proximately to where the first and second gears mesh; and wherein the bridge includes a ramp configured as a plane surface sloped relative to the base surface to provide a gradual transition from the first height to a second height such that height of the bridge is reduced relative to the base surface; and wherein the ramp generates a gradual re-expansion of the fluid away from the bridge and thereby reduces pump noise.

8. The engine of claim 7, wherein the ramp faces the suction chamber.

9. The fluid pump of claim 7, wherein the transition from the first height to the second height is one of cast and machined into the barrier.

10. The fluid pump of claim 7, wherein each of the first and second gears is an external spur gear type.

11. The engine of claim 7, wherein the ramp includes a first fillet arranged at the transition from the first height to the second height.

12. The engine of claim 11, wherein the barrier includes a second fillet where the bridge connects to the first portion and a third fillet where the bridge connects to the second portion.

13. A motor vehicle comprising:

an internal combustion engine configured to propel the vehicle, the engine including a cylinder block having an oil gallery; and a fluid pump configured to supply oil to the oil gallery, the pump having:

a housing that includes a base surface and defines a suction chamber, a discharge chamber, and a barrier extending from and arranged perpendicular to the base surface and having a first height relative to the base surface, wherein the barrier is configured to separate the suction chamber from the discharge chamber; and first and second gears rotatably disposed in the housing, configured to mesh and draw relatively low-pressure oil from the suction chamber, transform the relatively low-pressure oil into relatively high-pressure oil, and release the relatively high-pressure oil into the discharge chamber;

wherein the barrier includes first and second portions configured to accept the first and second gears respectively, and a bridge connecting the first and second portions, the bridge being disposed proximately to where the first and second gears mesh; and wherein the bridge includes a ramp configured as a plane surface sloped relative to the base surface to provide a gradual transition from the first height to a second height such that height of the bridge is reduced relative to the base surface; and wherein the ramp generates a gradual re-expansion of the fluid away from the bridge and thereby reduces pump noise.

14. The vehicle of claim 13, wherein the ramp faces the suction chamber.

15. The vehicle of claim 13, wherein the transition from the first height to the second height is one of cast and machined into the barrier.

16. The vehicle of claim 13, wherein the ramp includes a first fillet arranged at the transition from the first height to the second height.

17. The vehicle of claim 16, wherein the barrier includes a second fillet where the bridge connects to the first portion and a third fillet where the bridge connects to the second portion.

* * * * *